US008875958B2

(12) United States Patent
Last

(10) Patent No.: US 8,875,958 B2
(45) Date of Patent: Nov. 4, 2014

(54) PLASTIC SPOUT

(71) Applicant: ITSAC N.V., Curacao (NL)

(72) Inventor: Laurens Last, Parc Saint Romas (MC)

(73) Assignee: ITSAC N.V., Willemstad (NL)

( * ) Notice: Subject to any disclaimer, the term of this patent is extended or adjusted under 35 U.S.C. 154(b) by 10 days.

(21) Appl. No.: 13/716,746

(22) Filed: Dec. 17, 2012

(65) Prior Publication Data

US 2014/0110441 A1 Apr. 24, 2014

Related U.S. Application Data

(60) Continuation of application No. 11/804,161, filed on May 17, 2007, now Pat. No. 8,360,275, which is a division of application No. 10/492,474, filed as application No. PCT/NL02/00646 on Oct. 10, 2002, now Pat. No. 7,232,042.

(30) Foreign Application Priority Data

Oct. 11, 2001 (NL) ..... 1019161

(51) Int. Cl.
*B65D 25/40* (2006.01)
*B65D 75/58* (2006.01)
*B65D 25/48* (2006.01)

(52) U.S. Cl.
CPC ..... *B65D 25/48* (2013.01); *B65D 2575/583* (2013.01); *B65D 75/5883* (2013.01); *Y10S 383/906* (2013.01)
USPC ..... 222/566; 222/92; 222/107; 222/569; 383/906

(58) Field of Classification Search
USPC ..... 222/92, 107, 566–568; 383/906
See application file for complete search history.

(56) References Cited

U.S. PATENT DOCUMENTS 3,690,524 A 9/1972 Haberhauer
4,011,968 A 3/1977 McGhie et al.

(Continued)

FOREIGN PATENT DOCUMENTS

EP 0800994 A1 10/1997
EP 1284223 A1 2/2003

(Continued)

OTHER PUBLICATIONS

Search Report for Priority Application NL 1019196, Date of Search Report Jul. 8, 2002.

(Continued)

*Primary Examiner* — Frederick C Nicolas
(74) *Attorney, Agent, or Firm* — Hoffmann & Baron, LLP

(57) ABSTRACT

A plastic spout (150,170) which is adapted to be sealed between two foil walls of a pouch. The spout has a spout body, which forms a passage (153) for delivering a medium from the pouch and/or feeding a medium to the pouch. In a bottom part thereof, the spout, on opposite sides, forms a sealing zone for a sealed connection to an adjoining foil wall. The sealing zones of the spout body are formed by sealing walls (158,159) which project downward from the spout body, each having a curvature over their entire length, such that each sealing wall is outwardly convex over its entire length with respect to an imaginary plane passing through the outermost ends, which adjoin one another, of the sealing walls. The sealing walls can preferably move flexibly transversely with respect to their plane and, on their inner side, are unsupported or are supported by one or more flexible supporting parts of the spout body.

5 Claims, 3 Drawing Sheets

(56) References Cited

U.S. PATENT DOCUMENTS

| | | | | |
|---|---|---|---|---|
| 4,023,607 | A | 5/1977 | Jensen et al. | |
| 4,415,085 | A | 11/1983 | Clarke et al. | |
| 5,125,886 | A | 6/1992 | Dirksing | |
| 5,823,383 | A * | 10/1998 | Hins | 220/601 |
| 5,875,936 | A | 3/1999 | Turbett et al. | |
| 5,911,340 | A | 6/1999 | Uematsu | |
| 5,976,300 | A | 11/1999 | Buchanan et al. | |
| 6,000,848 | A * | 12/1999 | Massioui | 383/80 |
| 6,050,451 | A | 4/2000 | Hess, III et al. | |
| 6,127,009 | A | 10/2000 | Strassmann | |
| 6,131,806 | A | 10/2000 | Hess, III et al. | |
| 6,273,307 | B1 | 8/2001 | Gross et al. | |
| 6,439,429 | B1 | 8/2002 | Gross | |
| 6,612,466 | B1 | 9/2003 | Malin | |
| 6,644,519 | B2 * | 11/2003 | Last | 222/570 |
| 6,860,406 | B2 | 3/2005 | Kobetsky et al. | |
| 7,232,042 | B2 * | 6/2007 | Last | 222/1 |
| 8,360,275 | B2 * | 1/2013 | Last | 222/1 |

FOREIGN PATENT DOCUMENTS

| | | | |
|---|---|---|---|
| EP | 1182144 | B1 | 1/2004 |
| EP | 1106515 | B1 | 3/2004 |
| JP | 3-64229 | U | 6/1991 |
| JP | 2001-240083 | A | 9/2001 |
| WO | WO 96 21599 | A1 | 7/1996 |
| WO | WO 00 66448 | A1 | 11/2000 |

OTHER PUBLICATIONS

Search Report for Priority Application PCT/NL02/00646, Date of search report Mar. 19, 2003.

Written Opinion for Priority Application PCT/NL02/00646, Date of Mailing Jul. 16, 2003.

International Preliminary Examination Report for Priority Application PCT/NL02/00646, Publication Date Apr. 17, 2003.

English Machine Translation for JP 2001-240083, dated Dec. 6, 2012.

Partial English Translation for JP 3-64229, Publication Date Jun. 24, 1991.

* cited by examiner

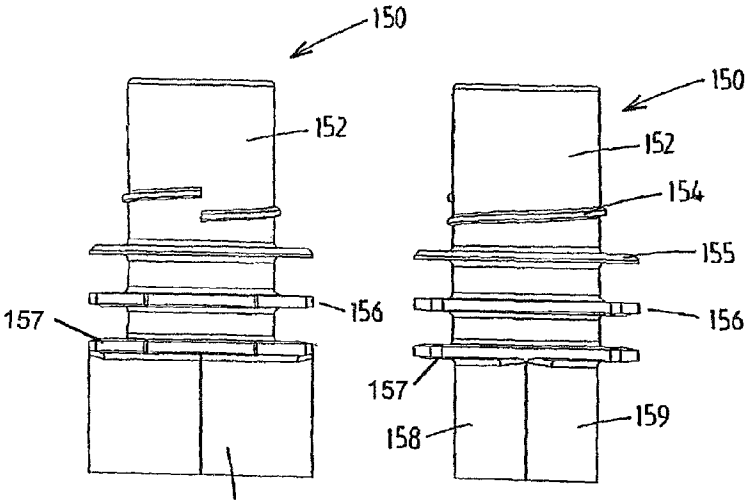
Fig.1B
Fig.1A
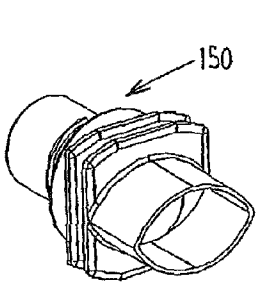
Fig.1E
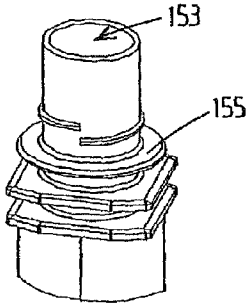
Fig.1D
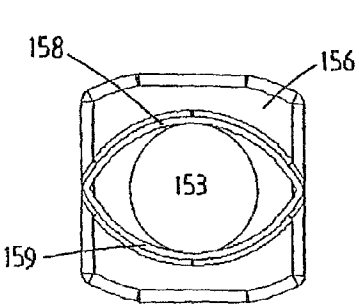
Fig.1C

PLASTIC SPOUT

CROSS-REFERENCE TO RELATED APPLICATIONS

This application is a continuation of U.S. application Ser. No. 11/804,161, filed May 17, 2007, now U.S. Pat. No. 8,360,275, which is a divisional of U.S. application Ser. No. 10/492,474, filed Aug. 18, 2004, now U.S. Pat. No. 7,232,042, which is the National Stage under 35 U.S.C. §371 of International Application No. PCT/NL02/00646, filed Oct. 10, 2002, which claims the benefit of Netherlands Application No. NL 1019161, filed Oct. 11, 2001, the contents of all of which are incorporated by reference herein.

FIELD OF THE INVENTION

The present invention relates to a plastic spout which is intended to be sealed between two foil walls of a pouch, comprising a spout body which forms a passage for delivering a medium from the pouch and/or feeding a medium to the pouch, which spout body, on opposite sides, forms a sealing zone for sealed connection to the adjoining foil wall.

The present invention also relates to a method for sealing a plastic spout between two foil layers of a pouch.

BACKGROUND OF THE INVENTION

WO 00/66448, in particular FIGS. 9a-d, in the name of the present applicant has disclosed a plastic spout, which is adapted to be sealed between two foil walls of a pouch. The known spout has a spout body with a central tubular part which forms a passage for delivering a medium from the pouch and/or feeding a medium to the pouch, the medium being, for example, a liquid, powder or gas.

The known spout body, on opposite sides thereof, forms a sealing zone for the adjoining foil wall. These sealing zones are formed by ribs, which project outwards from the central tubular part, lie at an axial distance from one another and adjoin bridge parts, which lie diametrically with respect to the tubular part. The ends of the bridge parts end in thin lips. As seen in the plane running transversely with respect to the tubular part of the spout body, the ribs, together with the adjoining bridge parts and the lips, form a boat-shaped contour on their outer circumference.

During the sealing, the known spout body is introduced between the foil walls of a pouch and a fused join is brought about between the sealing zones of the spout, which are formed by the outermost surfaces of the ribs, the bridge pieces and the lips, on the one hand, and the adjoining parts of the foil walls of the pouch, on the other hand.

The known spout body does not always prove satisfactory, in particular with regard to the sealed connection between the foil walls and the spout body. For example, one drawback is that producing the sealed connection requires undesirably large amounts of heat and time, with the result that the production rate is undesirably low. In practice, this sealing time is shortened by greatly increasing the pressure with which the foil walls are pressed onto the sealing zones, but this leads to a poor-quality sealed connection.

Another drawback of this known spout is that with certain types of foil, for example foil with a layer of aluminium, the ribs in the sealing zones may cause damage to the foil.

JP2001-240083 has disclosed a spout in accordance with the preamble of claim 1, the spout being provided on the underside with downward projecting thin sealing walls, which between them delimit a substantially oval space. When this known spout is being sealed between the foil walls of a pouch, the spout is first of all placed onto a support member which fits into the oval space. During the sealing, heated sealing jaws are placed onto the outer side of the foil walls, so that the sealing walls and adjoining foil walls, which are clamped between the support member and the sealing jaws, fuse and a welded joint is formed. The support member holds the sealing walls in the intended shape in this arrangement. The sealing walls are designed to be thin, making it possible to produce the sealed connection more quickly.

One drawback of the spout described in JP2001-240083 is that the support member requires the pouch to be open on the underside, so that the support member can project outwards. Furthermore, positioning the spout on the support member and removing the pouch from the support member after sealing has taken place takes up time, which once again slows the production process.

OBJECTS OF THE INVENTION

It is an object of the present invention, according to a first aspect thereof, to provide a spout which can be sealed in place without using the support member. It is a further object to provide a method to seal a plastic spout between two foils walls of a pouch.

SUMMARY OF THE INVENTION

For this purpose the first aspect of the invention provides a spout according to the preamble of claim 1 which is characterised in that the sealing walls each have a curvature over their entire length, such that each sealing wall is outwardly convex over its entire length with respect to an imaginary plane passing through the outermost ends, which adjoin one another, of the sealing walls.

This design of the sealing walls means that the sealing walls are stable if, during the sealing operation, external pressure is applied to the sealing walls by means of pressure-exerting means, such as heated sealing jaws. Even with a low thickness of the sealing walls (less than 2 millimeters), this stability is such that there is no need to use a support member during the sealing operation, with the result that the support member is preferably omitted.

When the spout is being sealed in place, only a small amount of heat is required to melt the sealing walls on the side of the foil walls which have been pressed onto them. This is because the heat which is supplied during sealing cannot be dissipated to parts of the spout which lie further away from the surface which is to be melted.

The heat required to form a seal can be provided using all known sealing methods, for example using heated sealing jaws and/or with the aid of ultrasound.

Further advantages of the spout with sealing walls according to the first aspect of the invention relate to the production of the spout in a suitable injection mould. This mould can be of relatively simple design, and furthermore the sealing walls require little plastic material. It is also possible for the cooling time for the sealing walls in the mould to be short, which is advantageous with regard to the production rate and cost price. Moreover, on account of the sealing walls, the mould can be provided with simple and efficient cooling means. In particular, the mould part which defines the inner side of the sealing walls and is composed of one or more components can be designed with a relatively large volume of material, so that there is space for efficient cooling means therein.

It is preferable for the sealing walls to be designed to be thin. The wall thickness of the sealing walls is in practice preferably at most 2 millimeters. The invention provides the possibility for the sealing walls to be designed with a thickness which as a minimum corresponds to the thickness of the foil walls.

It is preferable for the spout to be designed in such a manner that the sealing walls can move flexibly transversely with respect to their plane and on their inner side to be unsupported or supported by one or more flexible supporting parts of the spout body. Then, after the spout has been fitted in the pouch, these sealing walls have a shock-absorbing capacity and can yield elastically with foil walls of the pouch. This reduces the risk of damage to and possible leaks from the pouch at the location of the transition from the foil wall to a sealing wall. Furthermore, the flexibility of the sealing walls is advantageous for the production of the sealed connection, for example because broader dimensional tolerances of the spout body are acceptable without having an adverse effect on correct operation of the sealing device.

In a preferred embodiment, it is provided that the outer sides of the sealing walls, against which the foil walls come to bear, are of smooth design, i.e. without ribs or the like. This design is advantageous, for example, if the foil wall includes one or more layers of metal foil, in particular aluminium foil.

It is preferable for the spout body to comprise a transverse wall which extends transversely between the sealing walls, the passage extending through the transverse wall. The transverse wall is situated at the upper edge of the sealing walls. For example, an outwardly projecting tubular part of the spout body, which forms the passage, adjoins the transverse wall.

The first aspect of the invention also relates to the sealing of a plastic spout between foil walls, in particular of a pouch. In this aspect, use is made of pressure-exerting means which press the foil walls onto the sealing walls of the pouch without a support member internally supporting the sealing walls. In an advantageous embodiment, during the sealing of the spout use is made of pressure-exerting means which yield elastically to press the foil walls onto the sealing walls of the spout. By way of example, use is made of pressure-exerting jaws with an elastic layer, for example made from heat-resistant foam material.

In an advantageous embodiment, the spout or just the sealing walls is/are preheated before the spout is sealed into the pouch.

The present invention also relates to a pouch provided with a spout according to the invention.

Further advantageous embodiments of the spout according to the various aspects of the invention are described in the claims and the following description with reference to the drawings. The drawings are on a significantly enlarged scale compared to reality.

BRIEF DESCRIPTION OF THE DRAWINGS

FIG. 1A shows a side view of a first exemplary embodiment of the plastic spout according to the first aspect of the invention.

FIG. 1B shows a front view of the spout shown in FIG. 1A.

FIG. 1C shows a view from below of the spout shown in FIG. 1A.

FIG. 1D shows a perspective view of the spout shown in FIG. 1A from above.

FIG. 1E shows a perspective view of the spout shown in FIG. 1A from below.

DETAILED DESCRIPTION OF THE INVENTION

Figure 2A:
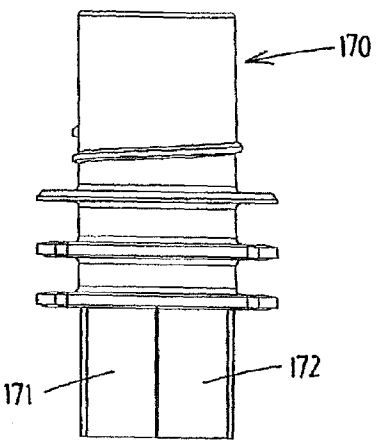
FIG. 2A shows a side view of a second exemplary embodiment of the plastic spout according to the first aspect of the invention.
Figure 2B:
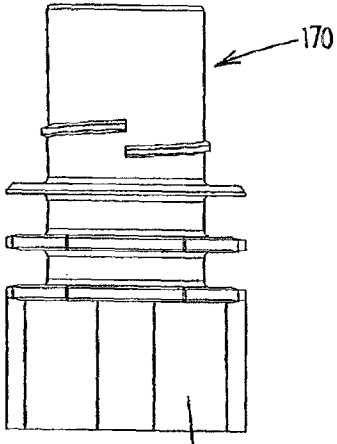
FIG. 2B shows a front view of the spout shown in FIG. 2A.
Figure 2C:
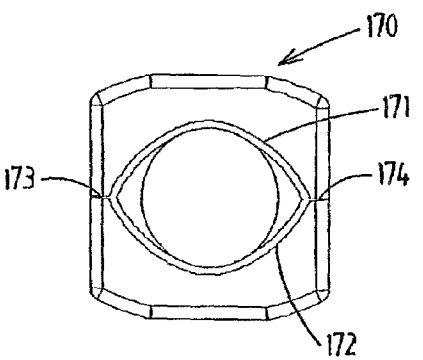
FIG. 2C shows a view from below of the spout shown in FIG. 2A.
Figure 2D:
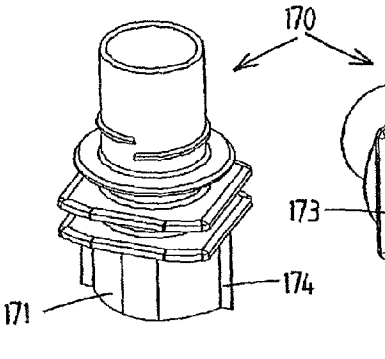
FIG. 2D shows a perspective view of the spout shown in FIG. 2A from above.
Figure 2E:
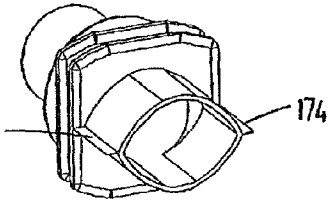
FIG. 2E shows a perspective view of the spout shown in FIG. 2A from below.
Figure 3A:
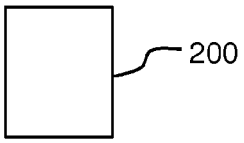
FIG. 3A shows a side view of a cap.
Figure 3B:
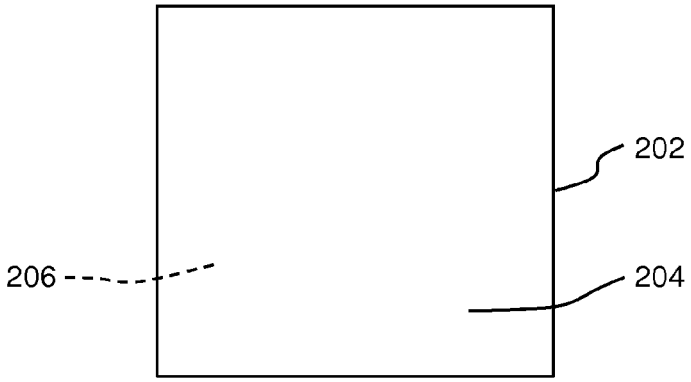
FIG. 3B shows a side view of a pouch.
Figure 3C:
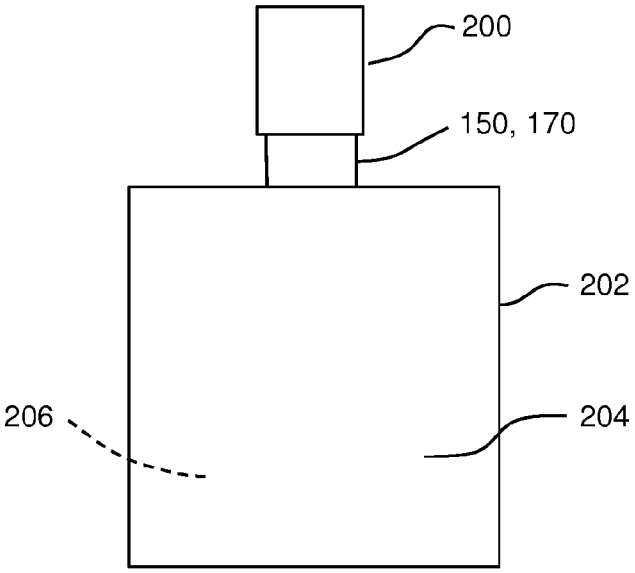
FIG. 3C shows a side view of a pouch with a cap and a plastic spout according to the present invention.

FIGS. 1A-E show a spout 150 which is produced by injection-moulding from a suitable plastic material and which is intended to be sealed between two foil walls (e.g., walls 204 and 206 in FIGS. 3B and 3C) of a pouch (e.g., pouch 202 in FIGS. 3B and 3C).

The spout 150 has a single-part spout body with, on the top side, an outwardly projecting tubular part 152 which forms a passage 153 for delivering a medium from the pouch and/or feeding a medium to the pouch.

The tubular part 152 is provided with a screw thread 154 for a screw cap (e.g., cap 200 in FIG. 3A), which can be used to close off the spout 150.

The outwardly projecting tubular part 152 is furthermore provided with a locking flange 155 for the screw cap and, beneath this, two circumferential flanges 156 which are used for handling means for the spout 150 and the pouch to engage on after the spout 150 has been sealed in the pouch.

On the underside, the spout 150 is provided with two sealing walls 158, 159 which project freely downwards, adjoin one another at their diametrically opposite ends and have an oval contour both on the inner side and on the outer side. The sealing walls 158, 159 adjoin the remainder of the spout body 150 only at their upper edge. Therefore, the sealing walls 158, 159 between them delimit an oval space.

The spout body 150 comprises a transverse wall 157 which extends transversely between the sealing walls 158, 159 and the passage 153 extending through the transverse wall 157. The transverse wall 157 is situated at the upper edge of the sealing walls 158, 159. The outwardly projecting tubular part 152 of the spout body 150, which forms the passage 153, adjoins the transverse wall 157.

In particular, the sealing walls 158, 159 have a curvature over their entire length, in such a manner that each sealing wall 158, 159 is externally convex with respect to the imaginary line passing through the outermost ends, which adjoin one another, of the sealing walls. This is more stable than the design which is known from the prior art in which the sealing walls have straight wall parts, and certainly more stable than the design according to the prior art in which the sealing walls have parts with an inwardly directed convexity. The latter variants provide too little resistance to the sealing walls being undesirably folded inwards, for example while the sealed connection is being produced.

The sealing walls 158, 159 are designed to be smooth on the outer side. The sealed connection to the foil walls can then be produced over virtually the entire surface of the thin sealing walls 158, 159. In this context, the thin design of the sealing walls 158, 159 makes a significant contribution to the short sealing time, since little heat has to be supplied in order to produce the fused connection.

The sealing walls 158, 159 have no internal support and are flexibly movable and can easily be moved transversely with respect to the plane of the sealing walls 158, 159.

The flexibility of the sealing walls 158, 159 provides the pouch with a shock-absorbing capacity, as can be seen from a test which involves dropping a filled pouch. Furthermore, the flexibility of the sealing walls 158, 159 avoids overloading the foil walls of the pouch in the vicinity of the bottom edge of the sealing walls 158, 159.

When the sealed connection is being produced, it is preferable to use jaws which completely surround the sealing walls, so that a sufficient pressure can then be obtained between the foil walls and the sealing walls.

In a variant, to produce the sealed connection sealing jaws which are provided with ribs or another profile, for example a waffle profile or a block profile, are used instead of sealing jaws with smooth jaw surfaces, so that the initial pressure is exerted at the location of the elevated parts of the profile.

In the spout 170 shown in FIGS. 2A-E, the sealing walls 171, 172 are designed with an even greater curvature than in the embodiment shown in FIGS. 1A-E.

At the location where the sealing walls 171, 172 meet, outwardly projecting thin lips 173, 174 are formed, these lips forming the transition to the parts of the foil walls of the pouch which are sealed together.

The inner side of the sealing walls may be of smooth design, as shown in the drawings, but it would also be possible to provide one or more formation, for example a thickened edge or a groove, in order to secure another component in the space between the sealing walls. By way of example, in this way it is possible for a flexible insert to be clipped into place, reducing the size of the effective area of the passage.

It will be clear that the spout body may have all kinds of designs, for example may be designed in combination with a stopper for closing off the passage, a male element if the spout is used as a connector, etc.

The invention claimed is:

1. A plastic spout which is adapted to be sealed between two foil walls of a pouch, comprising an injection moulded single part spout body comprising:

(a) a transverse wall;

(b) two thin, flexible sealing walls forming a sealing zone for a sealed connection to an adjoining foil wall, that each have an upper edge adjoining the transverse wall, wherein the two sealing walls have a length and adjoin one another at the outermost ends, wherein the sealing walls freely project perpendicularly downwards over a height from said transverse wall, said flexible sealing walls between them delimiting an open, oval space having essentially the same cross-sectional dimension over the height of the sealing walls, the dimension of the transverse wall exceeding that of the cross-section of the oval space, and said flexible sealing walls each have a curvature over the entire length of the sealing walls as viewed from below the spout, such that each sealing wall is outwardly convex over the entire length of the sealing walls with respect to an imaginary plane passing through the outermost ends of the sealing walls;

(c) thin lips, each formed at the location where the outermost ends of the sealing walls meet and projecting outwardly in said imaginary plane; and (d) an upwardly projecting cylindrical tubular part having a lower end adjoining the transverse wall, said tubular part projecting perpendicularly upwards from said transverse wall, the cross-section of the oval space exceeding that of the cross-section of the cylindrical tubular part, said tubular part forming at least a part of a passage that extends through the transverse wall and is in communication with said oval space for delivering a medium from the pouch or feeding a medium to the pouch, said tubular part including screw thread.

2. The plastic spout according to claim 1, in which the sealing walls have a maximum thickness of 2 millimeters.

3. The plastic spout according to claim 1, in which the outer sides of the sealing walls are of smooth design.

4. The plastic spout according to claim 1, in which the outwardly projecting tubular part is provided with one or more circumferential flanges for handling means for the spout to engage on.

5. The plastic spout according to claim 1, in which the tubular part of the spout body is provided with a screw thread for a cap.

* * * * *